United States Patent [19]

Denier et al.

[11] Patent Number: 4,677,994

[45] Date of Patent: Jul. 7, 1987

[54] PROCESS FOR TREATING, DRYING AND EXPANDING TOBACCO

[75] Inventors: Robert F. Denier, Louisville, Ky.; Robert H. Marshall, New Albany, Ind.; John N. Jewell, Macon, Ga.; Elmer F. Litzinger, Louisville, Ky.

[73] Assignee: Brown & Williamson Tobacco Corporation, Louisville, Ky.

[21] Appl. No.: 832,554

[22] Filed: Feb. 24, 1986

[51] Int. Cl.[4] ..... A24B 15/20; A24B 15/28

[52] U.S. Cl. ..... 131/310; 131/300; 131/302

[58] Field of Search ..... 131/296, 304, 302, 305, 131/300, 310, 311, 306

*Primary Examiner*—V. Millin

*Attorney, Agent, or Firm*—Charles G. Lamb

[57] ABSTRACT

An improved tobacco treating process for smoking articles including the steps of applying an ammonia source to tobacco to be dryed, passing the ammonia treated tobacco in a restricted pressure and flow controllable system to be entrained by pressurized steam for a preselected residence time before disentrainment therefrom, the steam being held at preselected minimum pressure and velocity to improve flavor quality and fill value of the tobacco.

23 Claims, 5 Drawing Figures

PROCESS FOR TREATING, DRYING AND EXPANDING TOBACCO

BACKGROUND OF THE INVENTION

1. Field of the Invention

The present invention relates to tobacco drying processes and more particularly to a process for forming favorable flavor compounds in a tobacco with an ammonia source while drying the tobacco at controlled pressures.

2. Description of the Prior Art

It is generally well known in the tobacco treating art to use alkali and steam to remove nicotine from tobacco. Long since expired U.S. Pat. No. 896,124 issued to G. B. Lindenberger, et al., on Aug. 18, 1908, teaches applying caustic soda to tobacco stems or stalks and passing steam successively through flow through chambers containing the tobacco at temperatures of 250° F. to 300° F. to extract nicotine and other volatile constituents from the tobacco. Long expired U.S. Pat. No. 246,975, issued to C. S. Phillips on Sept. 13, 1881 teaches utilizing ammonia gas to eliminate tobacco odors and U.S. Pat. No. 999,674, issued to J. Sartig on Aug. 1, 1911, teaches treating tobacco with ammonia for liberating nicotine and then passing steam below 212° F. continuously through the tobacco to carry off nicotine with the steam. U.S. Pat. No. 1,168,029, issued to J. K. Probst on Jan. 11, 1916, teaches treating cured tobacco with ammonia vapors at temperatures of 80° F. to 120° F. and U.S. Pat. No., 1,671,259, issued to T. Schlöesing on May 28, 1928, teaches circulating a mixture of steam and ammonia through tobacco at temperatures below 212° F. to remove nicotine at temperatures below 212° F. U.S. Pat. No. 1,880,336, issued to A. Wenusch on Oct. 4, 1932, teaches passing heated air through tobacco until the tobacco reaches 212° F. and then passing superheated steam therethrough to reduce the nicotine in the tobacco. U.S. Pat. No. 1,984,445, issued to W. Wagner on Dec. 18, 1934, teaches removing nicotine from tobacco by passing an ammonia vapor through the tobacco, aerating the tobacco and then exposing the tobacco to acetic acid while subjecting the tobacco to an evaporation heat. U.S. Pat. No. 2,136,485, issued to F. Berka, et al., on Nov. 15, 1983, teaches denicotizing tobacco by passing a mixture of air and ammonia therethrough at temperatures below 212° F. U.S. Pat. No. 4,153,063, issued to W. Roselius et al., on May 8, 1979, teaches denicotizing tobacco by passing carbon dioxide therethrough at very high pressure ranges and temperatures below 212° F.

A number of other patents, such as U.S. Pat. Nos. 3,151,118, issued to G. P. Moser on Sept. 29, 1964; 3,742,962, issued to C. Brochot on July 3, 1973, and 3,821,960, issued to L. Egri on July 2, 1974, teach or suggest the broad use of an ammonia source and steam at comparatively low temperature ranges below 250° F. for the purpose of denicotizing tobacco. Further, U.S. Pat. No. 3,760,815 issued to E. J. Deszyck on Sept. 25, 1973, teaches the use of an ammonia source and salts for the purpose of tobacco coherence. In addition, U.S. Pat. Nos. 3,771,533, issued to R. G. Armstrong et al., on Nov. 17, 1973; 4,248,252, issued to A. T. Lendvay et al., on Feb. 3, 1981; 4,266,562, issued to H. B. Merritt et al., on May 12, 1981, all suggest use of an ammonia source and $CO_2$, some even at temperatures in excess of 250° F., for purposes of puffing or expanding tobacco. In fact, flavor has been a consideration in utilizing an ammonia source for flavor enhancement of a synthetic material in U.S. Pat. Nos. 4,079,742 issued to N. B. Rainer et al., on March 21, 1978, and 4,184,495 issued to N. B. Rainer et al., on Jan. 22, 1980, and in utilizing an ammonia source with a carboxylic acid as taught by U.S. Pat. No. 4,286,606, issued to J. W. Swain et al., on Sept. 1, 1981. Other U.S. patents noted and being concerned with enhancing flavor through nitrogen, amino acid or ammonia treatment of tobacco have been U.S. Pat. Nos. 4,150,677; 4,306,577; and 4,379,464 respectively.

It is futher known to dry tobacco at high temperatures, the tobacco having initial moisture content usually above 16% and in the food processing art to entrain food in a heated gas stream to heat and discharge the food in a lower pressure zone. For example, U.S. Pat. No. 3,357,436, issued to A. H. Wright on Dec. 12, 1967, teaches improving tobacco fill value by drying at a temperature range between 250° F. to 600° F. and controlling moisture content of the tobacco to be dryed between 16 and 35% to provide dryed tobacco of between 9% and 23% moisture content. U.S. Pat. No. 3,661,071 and its divisional No. 3,754,930, both issued to R. Toei et al., on May 9, 1972, and Aug. 28, 1973, respectively, teach the drying of food stuffs in a pressurized heated gas stream and discharging the same to a zone of lower pressure. Further, U.S. Pat. No. 3,734,104, issued to W. Buchanan et al., on May 22, 1973, teaches rapidly heating and expanding moisturized tobacco for brief time periods of less than three seconds at temperatures as high as 750° F. to increase tobacco fill value and U.S. Pat. No. 4,167,191, issued to J. Jewell et al., on Sept. 11, 1979, teaches drying expanded tobacco by heating tobacco in steam and air at temperatures of 250° F. to 650° F. in the presence of an absolute humidity at a level above that which produces a wet-bulb temperature of at least 150° F. Moreover, two patents to B. Hedstrom, namely U.S. Pat. Nos. 3,808,093, issued on Apr. 30, 1974, and 4,043,049, issued on Aug. 23, 1977, as well as Canadian Pat. No. 879,811, issued on Aug. 31, 1971, teach drying of wood pulp in particulate form in entraining steam at elevated pressure, the steam heating and carrying the particulate pulp through the process. These aforenoted processes when involving tobacco have recognized the desirability of improving smoking quality and filling power but have either operated at atmospheric pressure when tobacco has been involved or, when operating under pressure, have involved food stuffs and wood pulps, requiring extensive and complex equipment in consideration of the product to be treated. Further, past tobacco treating processes utilizing an ammonia source and steam, have employed continuous flow through systems to extract nicotine from the treated tobacco or to expand the tobacco; or the past art has utilized an ammonia source and a specifically selected organic synthetic compound when flavor has been a consideration.

In accordance with the present invention, an improved, straightforward, efficient and economical tobacco drying process is provided which recognizes the advantages and benefits of drying tobacco at high temperatures and increased pressures and utilizing an ammonia source with the tobacco to be treated. The present invention further provides a process which, at the same time, avoids past required extensive, complex and expensive equipment costs involved in high temperature and pressure operations, obtaining and improved tobacco product for smoking articles, such as cigarettes, which has smoother and more flavorable smoking qualities with lower impact and irritation properties, lower nicotine and alkaloid ingredients and increased fill values.

Various other features of the present invention will become obvious to one skilled in the art upon reading the novel disclosure set forth herein.

SUMMARY OF THE INVENTION

More particularly, the present invention provides a process of forming favorable flavor compounds in a moisturized tobacco comprising: introducing pressurized superheated steam into a restricted pressure and flow controllable system; controlling the pressure differential and velocity flow of the superheated steam across the system so that the steam is at a preselected velocity to entrain and a preselected minimum pressure to improve the favorable flavor compounds and fill value of tobacco to be introduced into the system; applying an ammonia source to the tobacco treated in the system; introducing the tobacco through a first gas lock into the system to be entrained by the pressurized steam for a preselected residence time in the system; disentraining the ammoniated tobacco from the pressurized steam at the end of the residence time; and discharging the disentrained ammonia-treated tobacco from the system through a second gas lock into a zone of lower pressure.

It is to be understood that various changes can be made by one skilled in the art in the several steps of the inventive process disclosed herein without departing from the scope or spirit of the invention.

BRIEF DESCRIPTION OF THE DRAWINGS

Referring to the drawings which disclose one advantageous embodiment of the present invention.

DETAILED DESCRIPTION OF THE INVENTION

Figure 1:
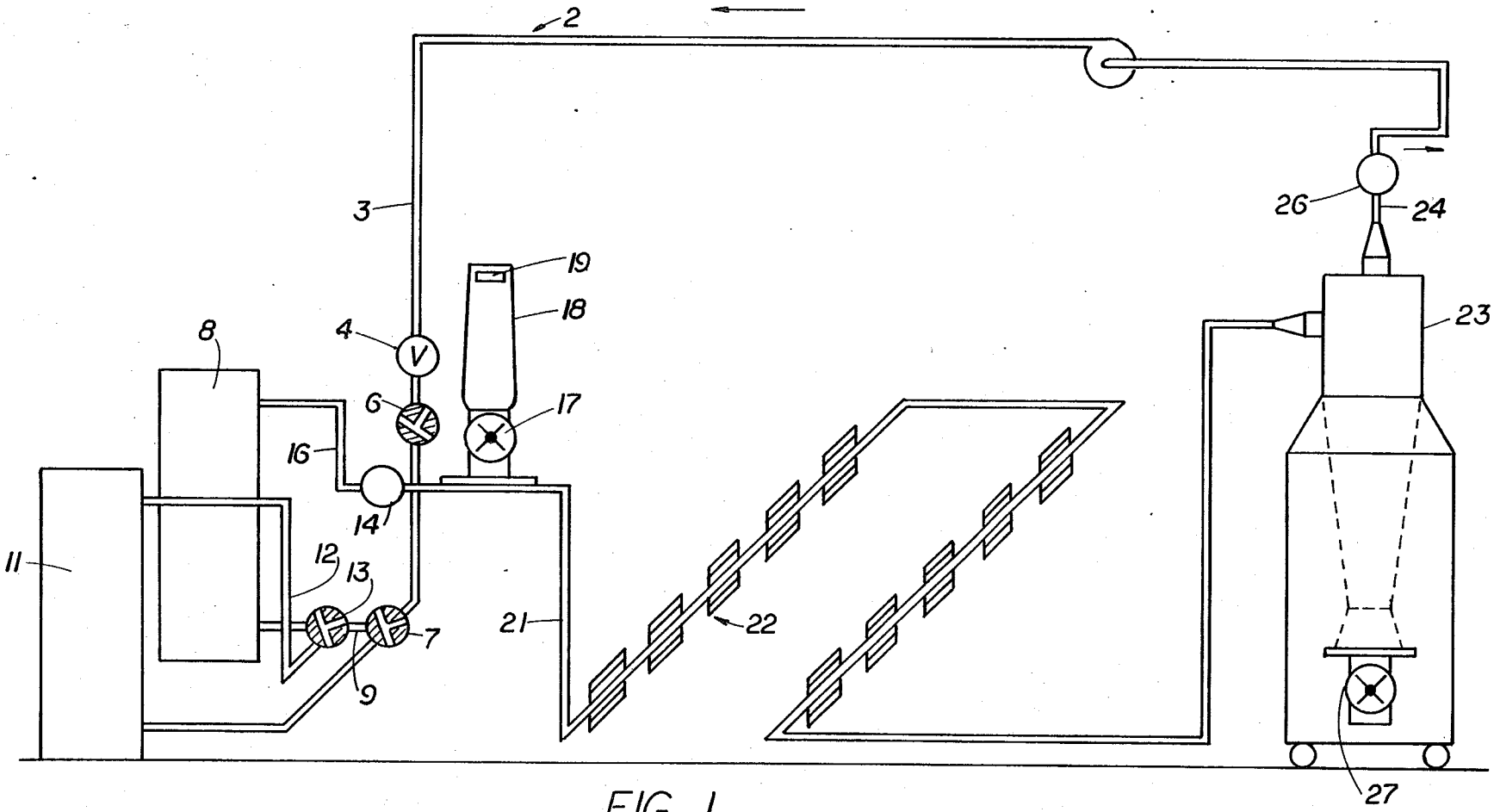
FIG. 1 is a schematic flow diagram of apparatus which can be used in carrying out the inventive process.

Referring to FIG. 1 of the drawings, in the inventive process, saturated steam at a pressure in the range of 120–150 psig is supplied to overall system 2 from a sutiable primary supply source such as a boiler (not shown) through supply line 3. The pressurized saturated steam passes through primary supply valve 4 and three-way valve 6. In accordance with one feature of the present invention and, if considered desirable to alter convective heat transfer rates or to change final product properties, a secondary gas such as helium, neon, hydrogen or air, some with a high convective heat transfer coefficient can be introduced into system 2 through three-way valve 6. Continuing along supply line 3, at three-way valve 7, the pressurized saturated steam can be diverted only into superheater 8 by way of line 9, or passed through both superheater 8 and superheater 11. If three-way valve 7 is set to pass steam through both superheaters 8 and 11, steam passes through superheater 11 to exit line 12 on its way to three-way valve 13. Three-way valve 13 can be set to allow flow into superheater 8, but prevent back flow along line 9. Upon passing the superheaters 8 and 11, the pressurized steam temperature can be set in the range of approximately 350° to 1000° F. It is to be noted that the two superheaters 8 and 11 serve to provide greater flexibility and heating capability depending on the type and moistures of the tobacco to be processed. It also is to be understood that it would be possible to carry out the inventive process without superheaters 8 and 11, depending upon the temperature of the pressurized steam as it is brought into supply line 3 from the primary supply boiler source.

When the pressurized steam has reached a preselected temperature it is passed through isolation valve 14 along line 16. In accordance with one feature of the present invention, line 16 is sized to impart a velocity in the range of approximately 800–6000 feet per minute to the steam, advantageously approximately 2500 feet per minute. The pressurized steam is passed along line 16 at the increased velocity below gas lock 17 through which a suitably selected tobacco to be treated enters into the system. Such tobacco generally has a moisture content in the range of 16% to 65% upon system entry and has been enhanced with a suitable ammonia source, such as ammonium hydroxide or an ammonia gas passed therethrough. The gas or air lock 17 is so designed to maintain high differential pressures between its inlet and discharge with minimun leakage. Although a rotary-type lock is schematically disclosed, it is to be understood that other types of feed mechanisms—such as tapered screw feeders—also can be used.

In accordance with the present invention, the ammonia-treated tobacco to be futher treated in the drying system is introduced at the top of confined chute 18 through inlet 19 by a suitable conveyor (not shown). It has been found to be desirable that the inlet 19 of confined chute 18 be positioned above the gas lock a sufficient distance to disentrain the ammonia-treated tobacco to be further treated from any steam being discharged from the system through the rotating pockets of the lock. Advantageously, an ammonia-treated tobacco drop of 4 to 8 feet in the chute has been found to be effective in this regard. It also has been found desirable to size the cross-sectional area of the chute relative to the system line to allow rapid depressurization of any steam discharged from the system through the rotating pockets of the lock so as to decrease steam velocity to a level of at least 150 feet per minute (the approximate fluidization value of tobacco) and advantageously less than 50 feet per minute. A cross-sectional area ratio of less than 0.03 to 1 between the line 16 and chute 18 has been found advantageous.

Upon entrance of the ammonia-treated tobacco into the system through lock 17, it is entrained in the high velocity pressurized steam and moved along line 21 through heat exchanger 22. Although any one of a number of known heat exchangers can be utilized in carrying out the inventive process, it has been found advantageous to utilize a series of steam-to-steam heat exchangers of concentric conduits positioned in horizontal flow fashion with the pressurized steam and tobacco entrained therein passing along the inside conduits and saturated steam supplied from a boiler (not shown) flowing along the outside conduits at a satisfactory differential pressure and temperature to prevent internal conduit condensation. Heat exchanger 22 serves to maintain the heat of the pressurized superheated steam with the tobacco entrained therein for a preselected residence time, advantageously in the range of 3 to 30 seconds. It is to be noted that the temperature of the steam (usually 365° F. at 150 psig from a factory boiler) brought to the outside conduits of the heat exchanger is usually below the temperature of the tobacco-entrained pressurized and superheated steam on the inside conduits of the heat exchanger 22 so that no heat is transferred to the steam being treated by exchanger 22, the exchanger acting primarily as an insulating unit to enhance treating residence time. It is to be understood, however, that other combinations of heat exchangers and tubes such as electric band heaters can be utilized and that, if desired, such heat exchangers can serve to provide additional heat to the tobacco entrained pressurized superheated steam. Further, under certain select conditions it would be possible to avoid use of heat exchangers at this point entirely.

From heat exchanger 22 in the system disclosed, the tobacco-entrained pressurized superheated steam is passed to a suitable steam-tobacco separator 23, which can be any one of a number of known gas-particle separators, such as cyclones or tangentials, and which, in advantageous embodiment disclosed, is of the cyclone type. The ammonia-treated tobacco entrained in the steam, which tobacco itself is maintained at a temperature in the range of approximately 280° F. to 320° F. and advantageously at 300° F., is disentrained from the steam by separator 23, the steam exiting from the top of the separator by way of line 24 passing through back pressure valve 26 after which its remaining heat can be utilized in other factory operations or recycled back to the superheaters 8 and 11 with the aid of a compressor or recirculation blower to restore pressure losses that might have occurred during the drying cycle.

It is to be noted that back pressure valve 26 serves as the primary means to control pressure within system 2. By partially closing valve 26, steam flow is restricted in the system to create a back pressure in the system and permitting pressure control within the system to minimun pressure within the range of approximately 20–100 psig and advantageously above 50 psig.

The ammonia-treated tobacco separated from the steam by the cyclone 23 is discharged through gas lock 27, which can be similar to gas lock 17 above discussed with the same conditions applying. The pressure above gas lock 27, which is in the system, is greater than the pressure outside or below gas lock 27, which is outside the system and which can be ambient. As a consequence, the rapid depressurization in the lower pressure zone assists in removing the ammonia-treated tobacco from the gas lock pockets without futher mechanical means.

In accordance with the present invention, it is desirable that the disentrained, depressurized ammonia-treated tobacco exiting from gas lock 27 be allowed to pass through a distance of 5 to 8 feet before reaching a conveyor (not shown) for further processing to reduce tobacco velocity and to thus minimize undesirable tobacco particle impact.

The several examples of data collected from testing selected tobacco samples as set forth hereinafter serve to illustrate the benefits and advantages of the inventive process described herein when compared with data collected from control samples processed under differing conditions.

EXAMPLE 1

Figure 2:
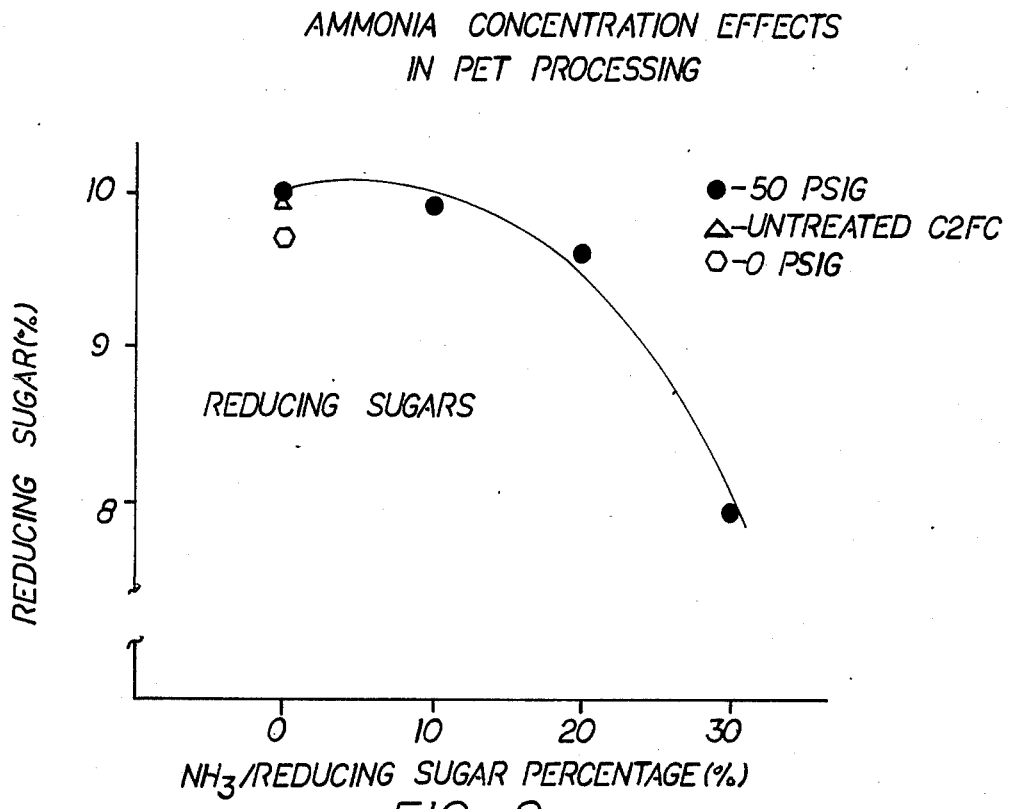
FIGS. 2, 3 and 4 are graphs illustrating how reducing sugars are decreased with increasing levels of an ammonia source having been applied to tobacco processed in accordance with the inventive series of steps; and, FIG. 5 is a bar graph comparing different pyrazine/-control ratios for untreated and ammonia-treated tobaccos.
Figure 3:
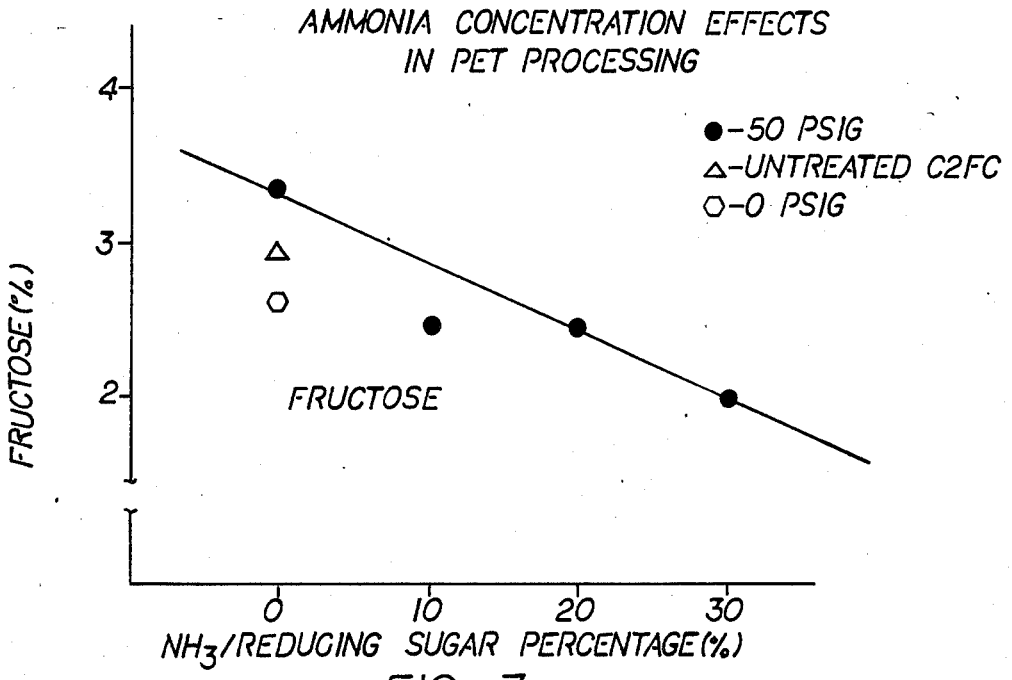
Figure 4:
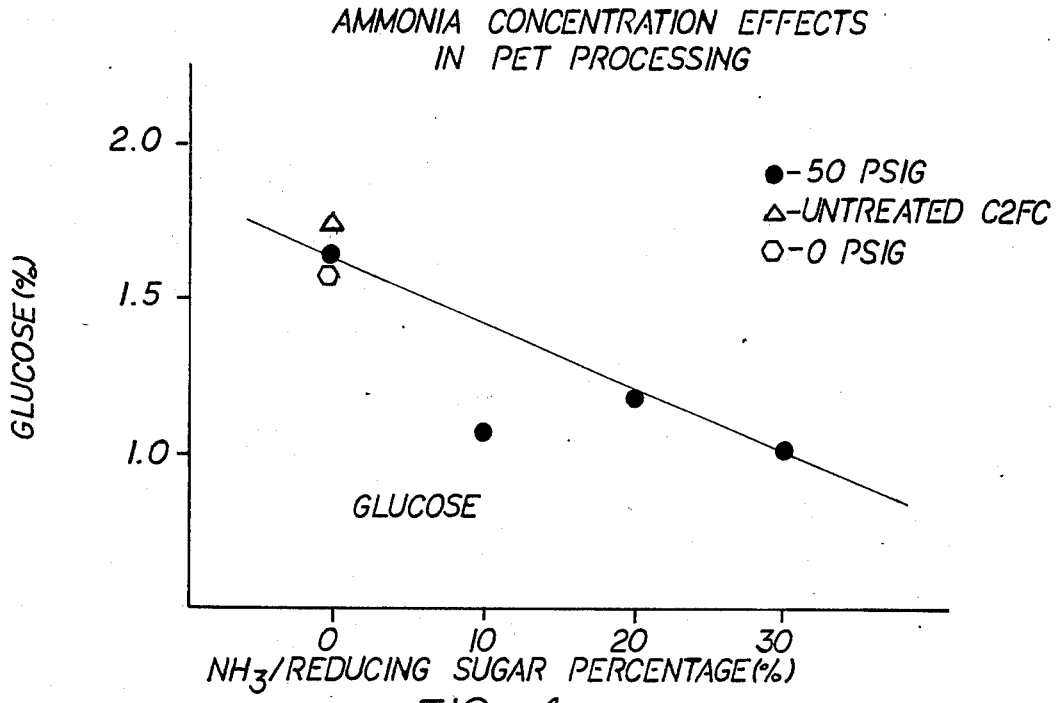

Three two-pound samples of a cut, flue-cured lamina tobacco having a starting moisture of 13% by weight were sprayed with an ammonia source, namely ammonium hydroxide solutions to obtain ammonia levels in the tobacco of 5, 10 and 15% by weight, based on a wet tobacco weight. Ammonium hydroxide concentration levels were so selected that target tobacco moisture after ammonia source treatment for each sample was 21% by weight. In addition, two 2-pound samples of like tobacco were sprayed with water only to the same 21% target moisture. A sample of unsprayed like tobacco with a 13% by weight moisture was used as an "untreated control." All three of the ammonium hydroxide treated samples and one of the two "water only" treated samples were then dryed in an apparatus as shown in FIG. 1. The operating pressure was 50 psig, the drying temperature was approximately 385° F. and the tobacco temperature was maintained at approximately 298° F. The other of the two "water only" samples was also dryed in the apparatus of FIG. 1, using 0 psig and approximately 285° F. drying conditions. Expert smokers found the "untreated control" and the "water only" 0 psig samples (Tests 1 and 2 respectively below) to have the highest levels of impact and irritation. The "water only" sample tested at 50 psig (Test 3 below) was lower in irritation but did not have as much flavor as the samples with 5, 10 & 15% ammonia levels (Tests 4, 5 and 6 below), it being noted that the flavor levels of the samples of Tests 4, 5 and 6 were not significantly different from one another. The data of the following Table 1 relating to the ammonia concentration effecting reducing sugars is shown in FIG. 2, the data relating to ammonia concentration effecting fructose is shown in FIG. 3 and FIG. 4 shows the relativity between the ammonia concentration effecting the glucose. The trend in the reduction of these components can be readily visualized and extrapolation of further data between the observed intervals may be made.

TABLE 1

| | Test 1 | Test 2 | Test 3 | Test 4 | Test 5 | Test 6 |
|---|---|---|---|---|---|---|
| Treatment | Untreated | Water only | Water only | 5% $NH_4OH$ | 10% $NH_4OH$ | 15% $NH_4OH$ |
| Syst. Press. (psig) | — | 0 | 50 | 50 | 50 | 50 |
| Alkaloids (%) | 1.86 | 1.49 | 0.94 | 0.80 | 0.75 | 0.73 |
| Red. Sugars (%) | 9.9 | 9.6 | 10.0 | 9.9 | 9.5 | 8.0 |
| pH (product) | 5.5 | 5.4 | 5.2 | 5.3 | 5.3 | 5.3 |
| Ammonia (%) | 0.04 | 0.13 | 0.05 | 0.09 | 0.13 | 0.13 |
| Fructose (%) | 3.04 | 2.75 | 3.52 | 2.46 | 2.41 | 2.06 |
| Glucose (%) | 1.87 | 1.63 | 1.77 | 1.16 | 1.22 | 1.05 |

EXAMPLE 2

Two four-pound samples of a cut, flue-cured, stem tobacco product having an initial moisture content of 55–60% by weight were sprayed with concentrated ammonium hydroxide to a 30% by weight target ammonia level. Two four-pound samples of similar wet stem tobacco were sprayed with concentrated ammonium hydroxide to a 60% by weight target ammonia level. A further two four-pound samples of like tobacco were left at the 55–66% moisture level without ammonium hydroxide treatment. One additional four-pound sample of like tobacco at 55–60% moisture level without ammonium hydroxide treatment was conditioned to a 14% target moisture in an atmosphere of 75° F., 60%Rh. to serve as a control. Samples, one each from the the 0%, 30% and 60% ammonium hydroxide samples, were dryed in an apparatus as shown in FIG. 1 at 0 psig system pressure (Tests 2, 3 and 4). The three remaining samples with 0%, 30% and 60% ammonium hydroxide samples were dried to approximately 14% moisture at 50 psig system pressure (Tests 5, 6 and 7). Expert smokers found the 60% $NH_4OH$, 50 psig sample (Test 7) had less impact and irritation than the sample dryed at 0 psig without any ammonium hydroxide addition (Test 2). It was further found that flavor compounds, such as pyrazines, were enhanced when ammonium hydroxide was used at 50 psig (Tests 6 and 7) as compared to an untreated control (Test 1). Without ammonium hydroxide addition (Tests 2 and 5) flavor compounds were actually lost, even at 0 psig system pressure (Test 2).

TABLE 2

| | Test 1 | Test 2 | Test 3 | Test 4 | Test 5 | Test 6 | Test 7 |
|---|---|---|---|---|---|---|---|
| Pressure (psig) | Untreated | 0 | 0 | 0 | 50 | 50 | 50 |
| Ammonium hydr. (%) | — | 0 | 30 | 60 | 0 | 30 | 60 |
| Alkaloids (%) | 0.46 | 0.31 | 0.25 | 0.25 | 0.17 | 0.14 | 0.13 |
| Red. Sugars (%) | 9.3 | 8.8 | 7.8 | 8.2 | 6.4 | 5.6 | 5.5 |
| Fructose (%) | 5.4 | 3.1 | 2.8 | 2.5 | 2.0 | 1.6 | 1.7 |
| Glucose (%) | 1.8 | 1.0 | 0.8 | 1.0 | 0.3 | 0 | 0 |
| Sucrose (%) | 2.1 | 1.8 | 1.9 | 2.1 | 1.2 | 1.2 | 1.2 |
| Ammonia (%) | 0 | .02 | 0.23 | 0.28 | 0.02 | 0.05 | 0.07 |
| pH (product) | 5.0 | 5.0 | 5.4 | 5.4 | 5.0 | 5.0 | 5.0 |

EXAMPLE 3

Figure 5:
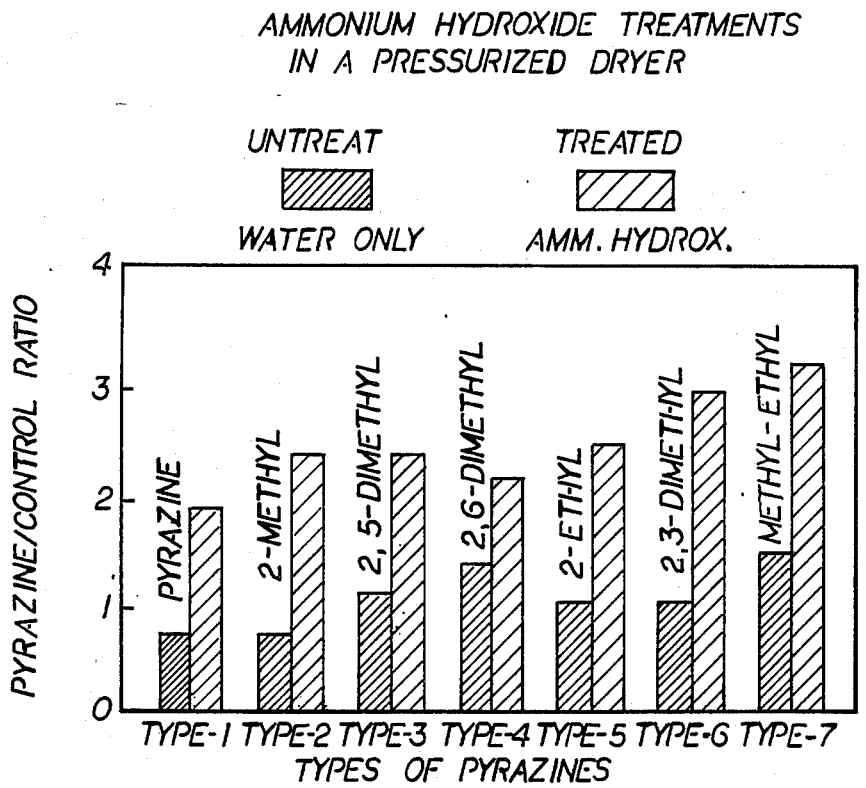

A two-pound sample of cut lamina blend tobacco, consisting of flue-cured, oriental, burley and reconstituted tobaccos, having an initial moisture content of 13% by weight was sprayed with an ammonium hydroxide solution to achieve a final applied base ammonia content of 5% by weight per pound of tobacco. Two additional two-pound samples of like tobacco were sprayed with water to achieve equal initial starting moisture levels of 33% by weight. One of these two water-treated samples (Test 1) was dryed to a final target moisture of 14% using drying apparatus as illustrated in FIG. 1. Operating pressure of the dryer for Test 1 was 0 psig with 500° F. drying temperature. The sample sprayed with ammonium hydroxide (Test 2) was also dryed in apparatus as illustrated in FIG. 1 at a pressure of 50 psig and a temperature of 500° F. The other of the water-treated samples was dryed in a conventional pneumatic dryer and served as a control sample (Test 3). Improvements in flavor and reduced irritation were observed by expert smokers for the ammonium hydroxide treated sample of Test 2 when this sample was mixed at a 1 to 9 ratio with a like tobacco sample which was untreated. Formation of flavor compounds was also observed as illustrated in FIG. 5. Additional data can be observed in Table 3.

TABLE 3

| | Test 1 | Test 2 | Test 3 |
|---|---|---|---|
| Treatment | Water | Ammonium hydroxide | Water (Conv) |
| Alkaloids (%) | 0.95 | 0.70 | 1.62 |
| Reducing Sugars (%) | 6.3 | 5.5 | 8.0 |
| Fructose (%) | 1.5 | 1.4 | 2.4 |
| Glucose (%) | 1.5 | 0.7 | 1.8 |
| Sucrose (%) | 1.4 | 1.4 | 1.8 |
| Ammonia (%) | 0.07 | 0.14 | 0.15 |
| pH (product) | 5.1 | 5.1 | 5.2 |
| Flavor Compounds (Ratio to Control) | | | |
| Pyrazine | 0.70 | 1.90 | — |
| 2-Methyl pyrazine | 0.67 | 2.40 | — |
| 2,5-Dimethyl pyrazine | 1.10 | 2.40 | — |
| 2,6-Dimethyl pyrazine | 1.35 | 2.17 | — |
| 2-Ethyl pyrazine | 1.06 | 2.43 | — |
| 2,3-Dimethyl pyrazine | 1.0 | 3.00 | — |
| Methylethyl pyrazine | 1.49 | 3.27 | — |

It is to be understood that although ammonium hydroxide was used to obtain the desired ammonia base level in certain of the samples of the Examples set forth hereinabove, a suitable ammonia gas source to obtain desired ammonia base levels could also have been utilized.

The invention claimed is:

1. A process of forming favorable flavor compounds in a moisturized tobacco comprising: introducing pressurized superheated steam into a restricted pressure and flow controllable system; controlling the pressure differential and velocity flow of said superheated steam across said system so that said steam is at a preselected velocity to entrain and a preselected minimum pressure to improve the favorable flavor compounds and fill value of tobacco to be introduced into said system; applying an ammonia source to the tobacco treated in said system; introducing the tobacco through a first gas lock into said system to be entrained by said pressurized steam for a preselected residence time in said system; disentraining the ammonia-treated tobacco from said pressurized steam at the end of said residence time; and discharging the disentrained ammonia-treated tobacco from said system through a second gas lock into a zone of lower pressure.

2. The process of claim 1, said ammonia source being an ammonia gas contacted with said tobacco.

3. The process of claim 1, said ammonia source being ammonium hydroxide.

4. The process of claim 1, the pressurized steam being maintained in said system in a minimum range of approximately 20–100 psig.

5. The process of claim 1, the pressurized steam being maintained in said system at not below approximately 50 psig.

6. The process of claim 1, including superheating said steam within said system to a temperature range of approximately 350° F. to 1000° F.

7. The process of claim 1, including superheating said steam within said system in at least two heat zones in accordance with type and moisture content of tobacco to be introduced into said system.

8. The process of claim 1, said superheated steam being maintained at a velocity in the range of approximately 800–6000 feet per minute.

9. The process of claim 1, said superheated steam being maintained at a velocity of approximately 2500 feet per minute.

10. The process of claim 1, said tobacco having an introduction moisture content in the range of approximately 21% to 60%.

11. The process of claim 1, said tobacco being introduced into said first airlock from a preselected confined height to disentrain tobacco from returning pockets of said first airlock.

12. The process of claim 1, said tobacco being introduced into said first airlock from a height of approximately 4 to 8 feet.

13. The process of claim 1, said tobacco being introduced into the closed system having a conduit carrying the superheated steam at a preselected velocity through a confined chute leading into said first airlock, the cross-sectional area between conduit and chute being in a ratio of less than 0.03 to 1.0.

14. The process of claim 1, including passing said tobacco-entrained steam through a heat exchange zone in said system to maintain the heat level in said steam for a preselected time.

15. The process of claim 1, including passing said tobacco-entrained steam through a heat exchange zone to maintain said steam at approximately 350° F. for a preselected time.

16. The process of claim 1, said preselected residence time being in the range of approximately 3 to 30 seconds.

17. The process of claim 1, said tobacco being disentrained from said steam by centrifugal force.

18. The process of claim 1, said tobacco being disentrained from said steam by centrifugal force through a tangential separator.

19. The process of claim 1, said disentrained tobacco passing through a height of approximately 4 to 8 feet in said zone of lower pressure before further processing.

20. The method of claim 1, and reordering said treated tobacco to a moisture content of 12% to 15% by weight.

21. The method of claim 1, said tobacco having a moisture content advantageously in the range of approximately 14%–21% by weight when introduced into said system.

22. The method of claim 1, said temperature range of said tobacco in said system being maintained preferably in the range of approximately 280° F. to 320° F.

23. The method of claim 1, said temperature of said tobacco being maintained advantageously at 300° F.

* * * * *